US005791184A

United States Patent [19]

Wu

[11] Patent Number: 5,791,184

[45] Date of Patent: Aug. 11, 1998

[54] SPRING-MAKING MACHINE

[76] Inventor: Chin-Tu Wu, P.O. Box 82-144, Taipei, Taiwan

[21] Appl. No.: 711,662

[22] Filed: Sep. 9, 1996

[51] Int. Cl.[6] ..... B21F 35/02

[52] U.S. Cl. ..... 72/137; 72/138; 72/140

[58] Field of Search ..... 72/137, 139, 140, 72/142, 404, 442, 449, 307

[56] References Cited

U.S. PATENT DOCUMENTS

| | | | |
|---|---|---|---|
| 4,656,860 | 4/1987 | Orthuber et al. | 72/307 |
| 4,665,731 | 5/1987 | Yagi et al. | 72/307 |
| 4,825,678 | 5/1989 | Post | 72/307 |
| 4,947,670 | 8/1990 | Wu | 72/137 |
| 5,452,598 | 9/1995 | Cheng | 72/137 |

*Primary Examiner*—Lowell A. Larson
*Assistant Examiner*—Rodney A. Butler
*Attorney, Agent, or Firm*—A & J

[57] ABSTRACT

A spring-making machine including a spring wire feeding device having a frame, a driving disk rotatably mounted on the frame, a first sleeve fixedly arranged on one side of the frame and having a plurality of fixing holes, a second sleeve inserted into the first sleeve and fixedly mounted on the driving disk, and an elongated core having a sectorial portion with an angle less than 180 degrees at an end thereof and a opening at another end, the core having an axial hole and a radial outlet, a guide rod having an axial hole adapted to receive a spring wire and having an end inserted into the axial hole of the core, and a clamp having a recess in which is fitted another end of the guide rod and a bolt extending through the clamping means to engage with the guide rod.

1 Claim, 14 Drawing Sheets

SPRING-MAKING MACHINE

BACKGROUND OF THE INVENTION

1. Field of the Invention

This invention is related to an improved spring-making machine.

2. Description of the Prior Art

It has been found that specially purpose machines are used for mass production of springs. Nevertheless, all such machines on the market are inconvenient to use, and they are too complicated in structure, impractical and too expensive in cost.

In U.S. Pat. No. 4,947,670 to the same inventor as the present application, a universal automatic spring-making machine is disclosed. Nevertheless, the feeding sequence of the forming tools is complicated and furthermore, a number of forming tools must be fed at the same time when making springs of multiple orientations there increasing the time required for the feeding of the forming tools and therefore, decreasing the production rate.

Therefore, it is an object of the present invention to provide an improved spring-making machine which can obviate and mitigate the above-mentioned drawbacks.

SUMMARY OF THE INVENTION

This invention is related to an improved spring-making machine.

It is the primary object of the present invention to provide an improved spring-making machine which can reduce the stroke number of the forming tool.

It is another object of the present invention to provide an improved spring-making machine which can be used for producing springs of multiple orientations.

It is still another object of the present invention to provide an improved spring-making machine which is simple and sturdy in construction.

It is still another object of the present invention to provide an improved spring-making machine which can simplify the procedures for making springs.

It is a further object of the present invention to provide an improved spring-making machine which can increase the production rate of making springs.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
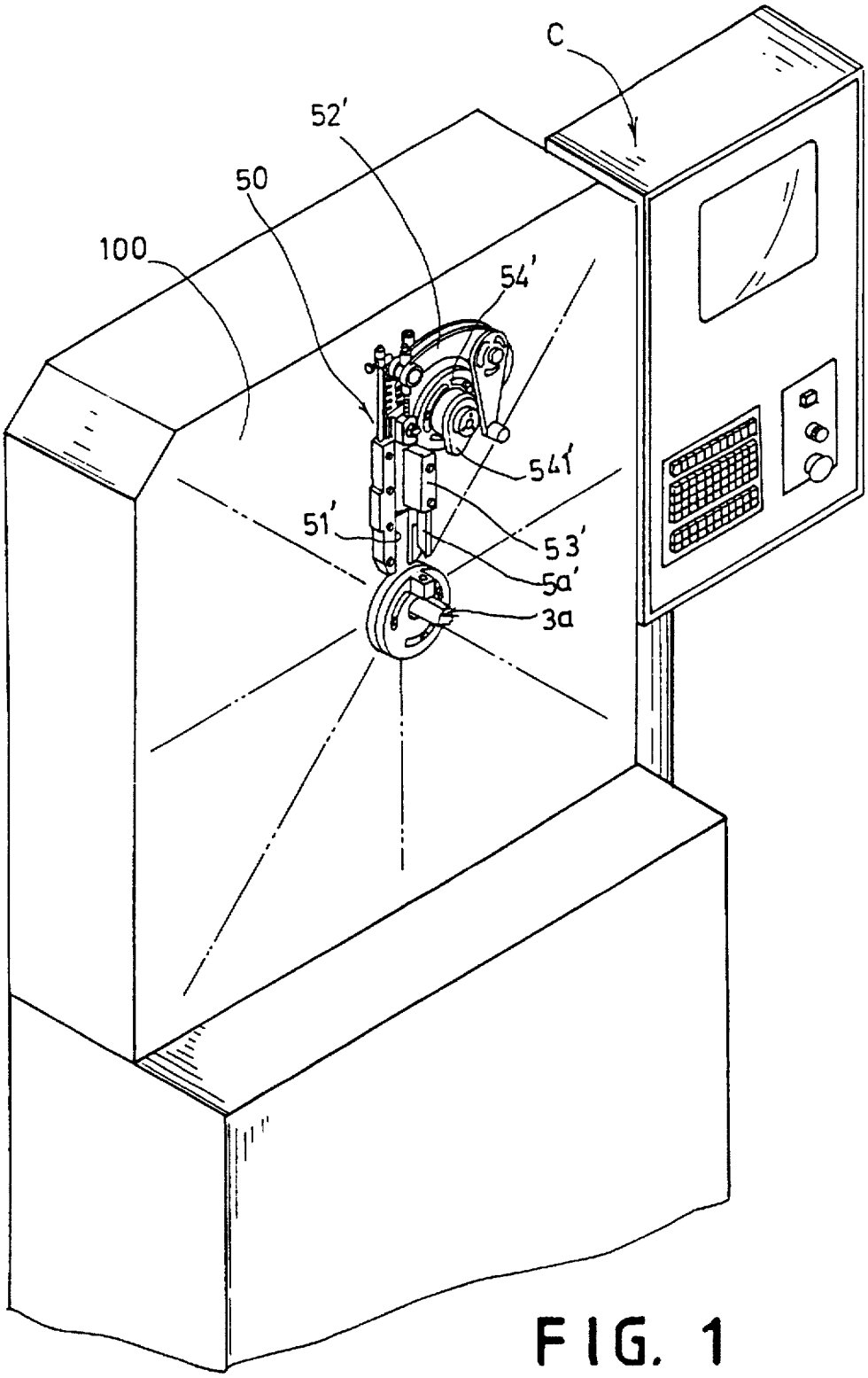
FIG. 1 is a perspective view of a spring-making machine according to the present invention.
Figure 2:
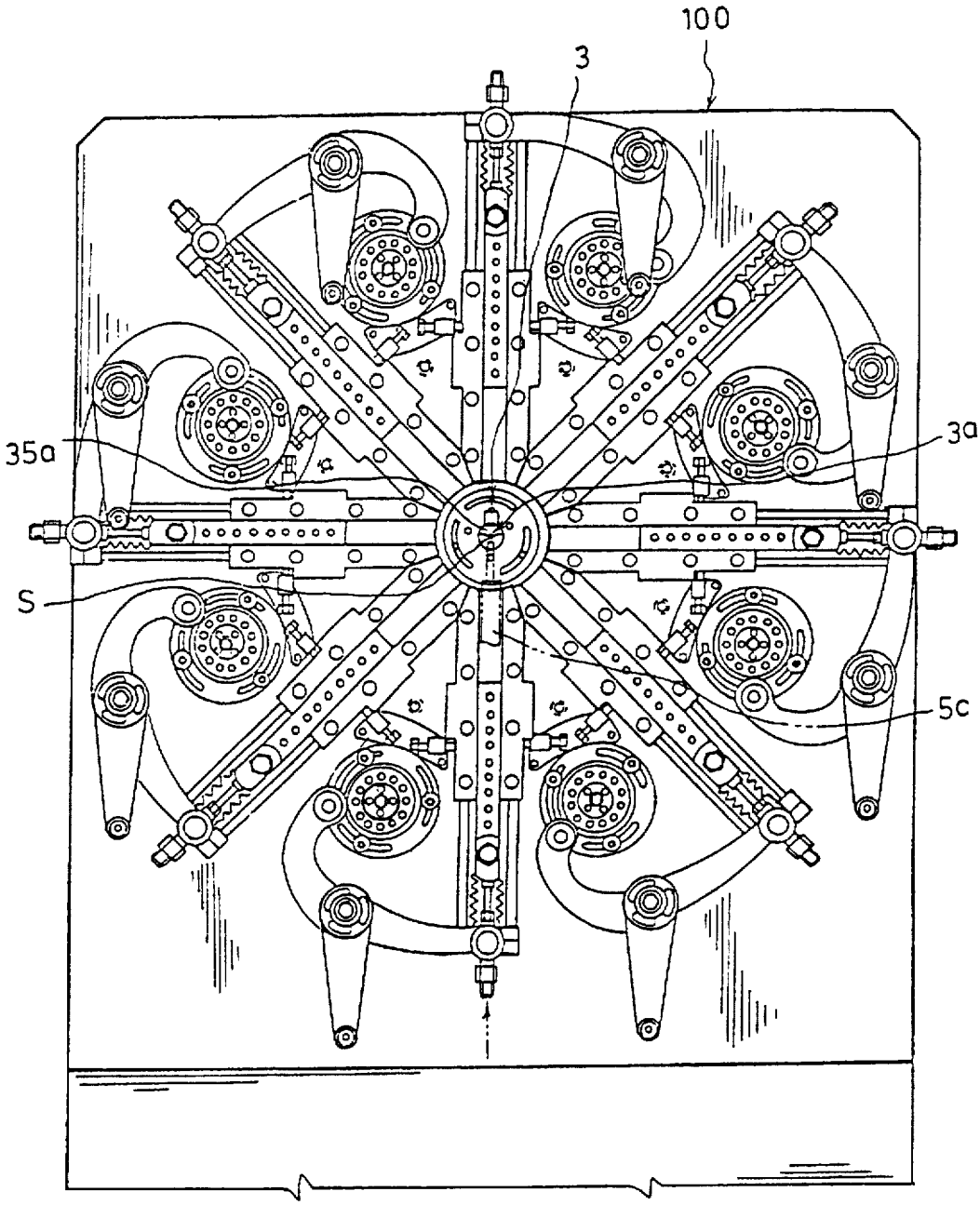
FIG. 2 illustrates the distribution of tool guiding means on a panel of the spring-making machine.
Figure 3:
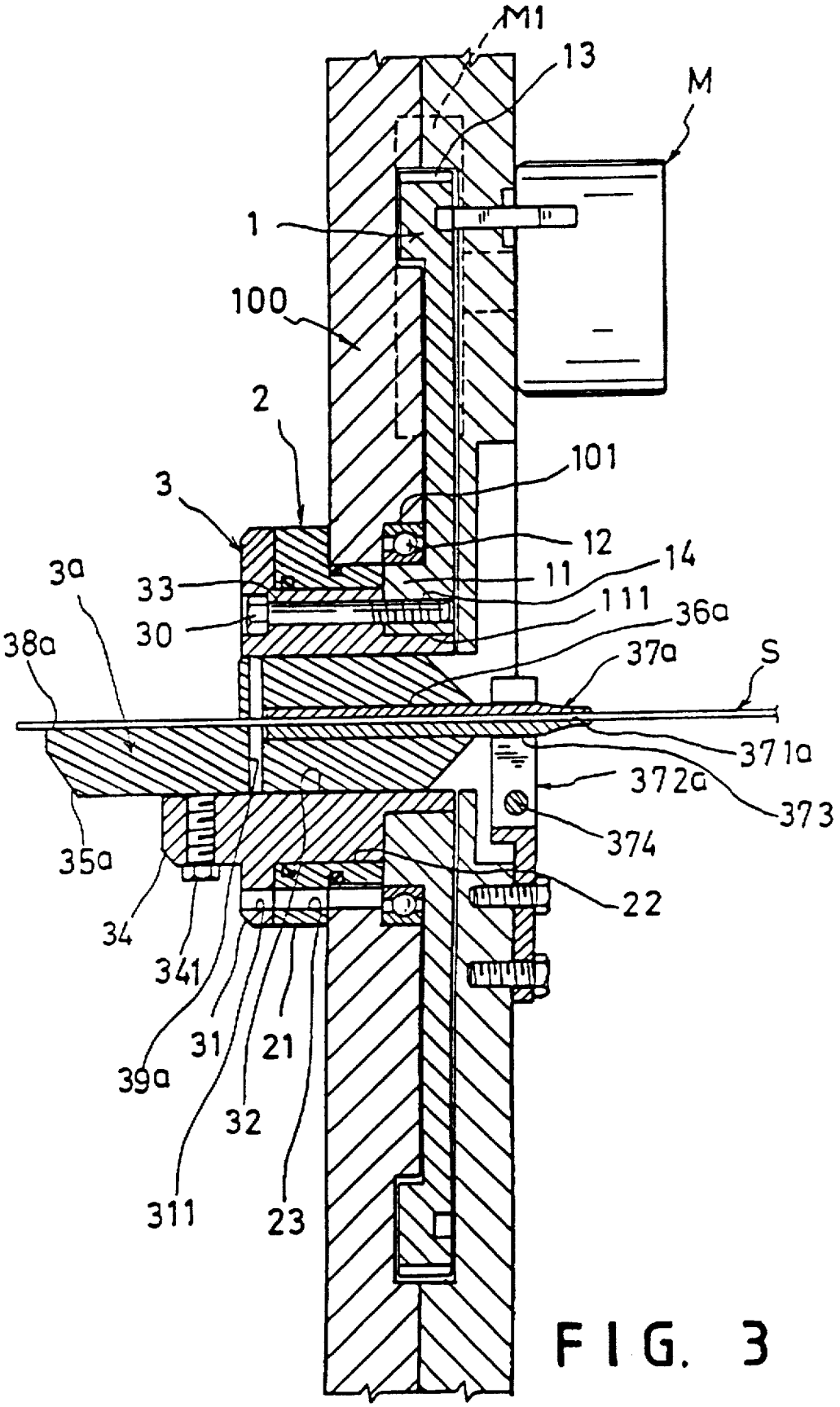
FIG. 3 is sectional side view of the spring wire feeding device according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1 through 8 thereof, the spring-making machine according to the present invention comprises a frame 100 on which are mounted a spring wire feeding device and eight sets of tool guiding means 300. As shown in FIGS. 3, 4, 5 and 6, the spring wire feeding device includes a driving disk 1, a first sleeve 2 and a second sleeve 3. The driving disk 1 is rotatably mounted on the right side of the frame 100 (with respect to FIG. 3). The first sleeve 2 is fixedly arranged on the left side of the frame 100. The second sleeve 3 is provided with a core 3*a* therein which is controlled by a microprocessor controller C so that the core 3*a* will be rotated to prevent blocking the motion of the forming tools (see FIG. 5) thereby reducing the number of strokes of the forming tools for making a spring.

The driving disk 1 is formed with a neck portion 11 fitted into a hole 101 of the frame 100. The neck portion 11 is provided with a bearing 12 thereon. The driving disk 1 has teeth 13 on its edge meshed with a gear M1 9 (see FIG. 8) drivingly connected with a driving motor M so that the driving disk 1 can be driven by the driving motor M. The driving disk 1 has a hole 111 at the center.

The first sleeve 2 is fixedly arranged on one side of the frame 100 and has a flange 21 in contact with the frame 100. The first sleeve 2 is formed with a hole 22 at the center for receiving the second sleeve 3. The flange 21 of the first sleeve 2 has a plurality of holes 23 which are equidistant from each other.

Figure 5:
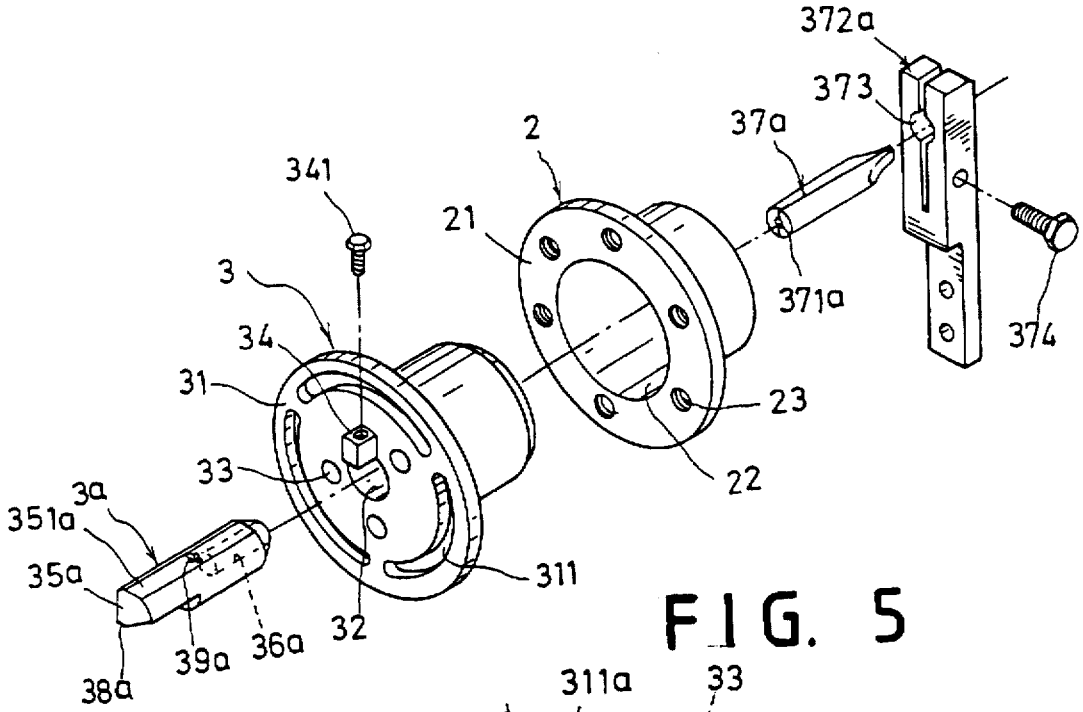
FIG. 5 shows the relationship between the spring wire, the core, the second sleeve, the first sleeve, the guide rod and the clamping means.
Figure 6:
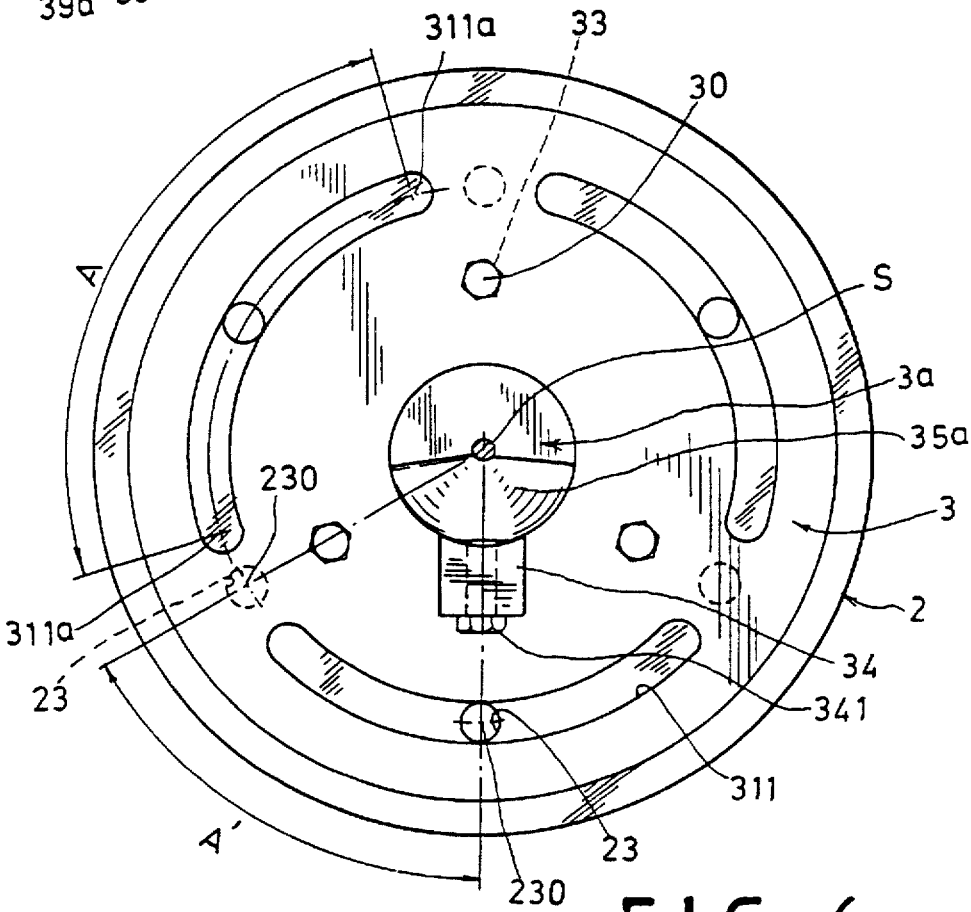
FIG. 6 is a front view of the second sleeve in which is fitted the first sleeve.

Referring to FIGS. 5 and 6, the arc between two adjacent holes 23 of the first sleeve 2 subtends an angle A' which is, for example, 60 degrees. However, the number of the holes 23 is not limited in this case.

The second sleeve 3 is inserted into the first sleeve 2 and has a flange 31 in contact with the flange 21 of the first sleeve 2. The flange 31 of the second sleeve 2 is formed with at least a curved slot 311 so that when the second sleeve 3 is fitted into the first sleeve 2, there is least a hole 23 of the first sleeve 2 aligned with the curved slot 311 of the second sleeve 3. The second sleeve 3 has a center through hole 32 for receiving a core 3*a* and a plurality of holes 33 aligned with the holes 14 of the driving disk 1. The second sleeve 3 is fixedly mounted on the driving disk 1 by bolts 30 extending through the holes 33 of the former and the holes 14 of the latter thereby enabling the second sleeve 3 to rotate in unison with the driving disk 1. The second sleeve 3 has a raised portion 34 close to the center hole 32. A screw 341 extends through the raised portion 34 of the second sleeve to engage with a flat portion 351*a* of the core 3*a* fitted into the hole 32 of the second sleeve 3.

As shown in FIG. 6, the second sleeve 3 is formed with a plurality of curved slots 311 having two semi-circular ends. The arc between the centers of the two semi-circular ends of each of the curved slots 311 subtends an angle A which is equal to or larger than the angle A' between two adjacent holes 23 of the first sleeve 2. Further, there is at least one hole 23 of the first sleeve 2 in alignment with each of the curved slots 31 of the second sleeve 3.

The core 3*a* is an elongated member having a sectorial end with an angle less than 180 degrees. The other end of the core 3*a* is formed with a hole 36*a* for receiving a guide rod 37*a*. The core 3*a* has an axial hole 38*a* for the passage of a spring wire S. A radial outlet 39*a* is formed on the core 3*a* so that when a spring wire A passes through the core 3*a*, the dirts or the like attached on the spring wire A will be discharged from the radial outlet 39*a* thus preventing the axial hole 38*a* from being blocked.

The guide rod 37*a* is composed of two halves and is formed with an axial hole 38*a* for receiving the spring wire S. One end of the guide rod 37*a* is inserted into the hole 36*a* of the core 3*a*, while the other end of the guide rod 37*a* is fixed by a clamp 372*a*. The clamp 372*a* has a recess 373 at an upper end thereof and a vertical slit extending through the recess 373. A screw 374 transversely extends into the upper portion of the clamp 372*a* to fix the guide 37*a* into the clamp 372*a*. The lower end of the clamp 372*a* is fixedly mounted on the frame 100 so that the guide rod 371 and the spring wire S will not rotated in unison with the driving disk 1.

Figure 4:
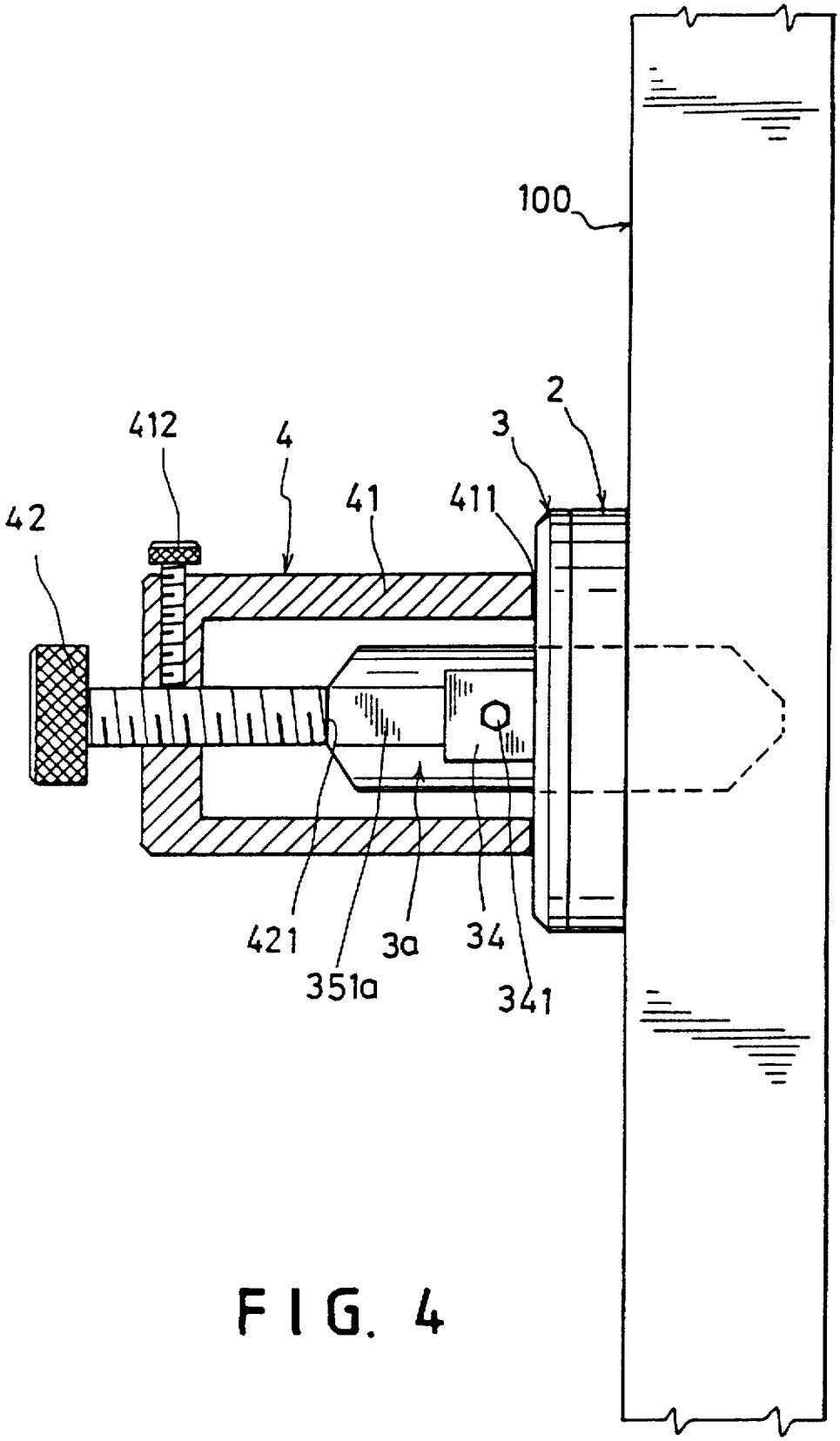
FIG. 4 illustrates how to adjust the length of the spring wire protruding out of the core.

Before operation, it is necessary to use a gauge 4 to adjust the length of the spring wire S protruding out of the core 3*a*. As illustrated in FIG. 4, the gauge 4 includes a body portion 41 and an adjusting screw 42 axially extends through the body portion 41. The adjusting screw 42 is regulated so as to obtain the required distance between the end of the adjusting screw 42 and the end of the body portion 41. The position of the adjusting screw 42 is fixed by a fixing screw 412. When desired to adjust the length of the spring wire S protruding of the core 3*a*, it is only necessary to put the gauge 42 on the second sleeve 3 with the body portion 41 enclosing the core 3*a* and then adjust the core 3*a* to make the end of the core 3*a* contact the end of the adjusting screw 42 thereby enabling the core 3*a* to be accurately and conveniently adjusted in position.

As shown in FIGS. 1, 2, 8, 8A and 8B, each of the eight sets of tool guiding means 300 includes: a slide base 90 adjustably pivotally secured on a fulcrum disk 10 mounted on the frame 100 and also firmly fixed on the frame 100 by means of the fixing plate 110 fixed on the frame 100, a positioning adjuster 120 provided by side of each guiding means 300 for adjusting the position or orientation of the guiding means 300 around the disk 10 a tool slide 130 slidably held in a longitudinal groove 140 of the slide base 90 to define the longitudinal groove 140 of the slide base 90, and two tension springs 190 each having an inner spring end secured into a hole 200*a* formed in an upper portion of the tool slide 130 and having an outer spring end secured to a screw 170 having a collar 180 secured to a stem 160 fixed on the slide base 90 for normally pulling the slide 130 outwardly. A collar 230 is fixed on one stem 16 for limiting the outermost movement of the slide 130. The spring 190 after poking through the hole 20*a* is secured to a pin 220 transversely inserted in a lateral pin hole 21. A crank means 500 of the present invention includes: a crank handle 270 pivotally secured on a central shaft 290 secured to the frame 100 by screws fixed in holes 32 having a first end of the handle 270 pivotally secured with a roller 280 operatively acted by a first cam 8 and having a second end pivotally secured with a side shaft 26 which is connected to the slide 130 by a screw 240, an auxiliary arm 800 also pivotally secured to the central shaft 290 having an outer arm end secured with a second roller 310 for operatively driving the second cam 80*a*.

Figure 7:
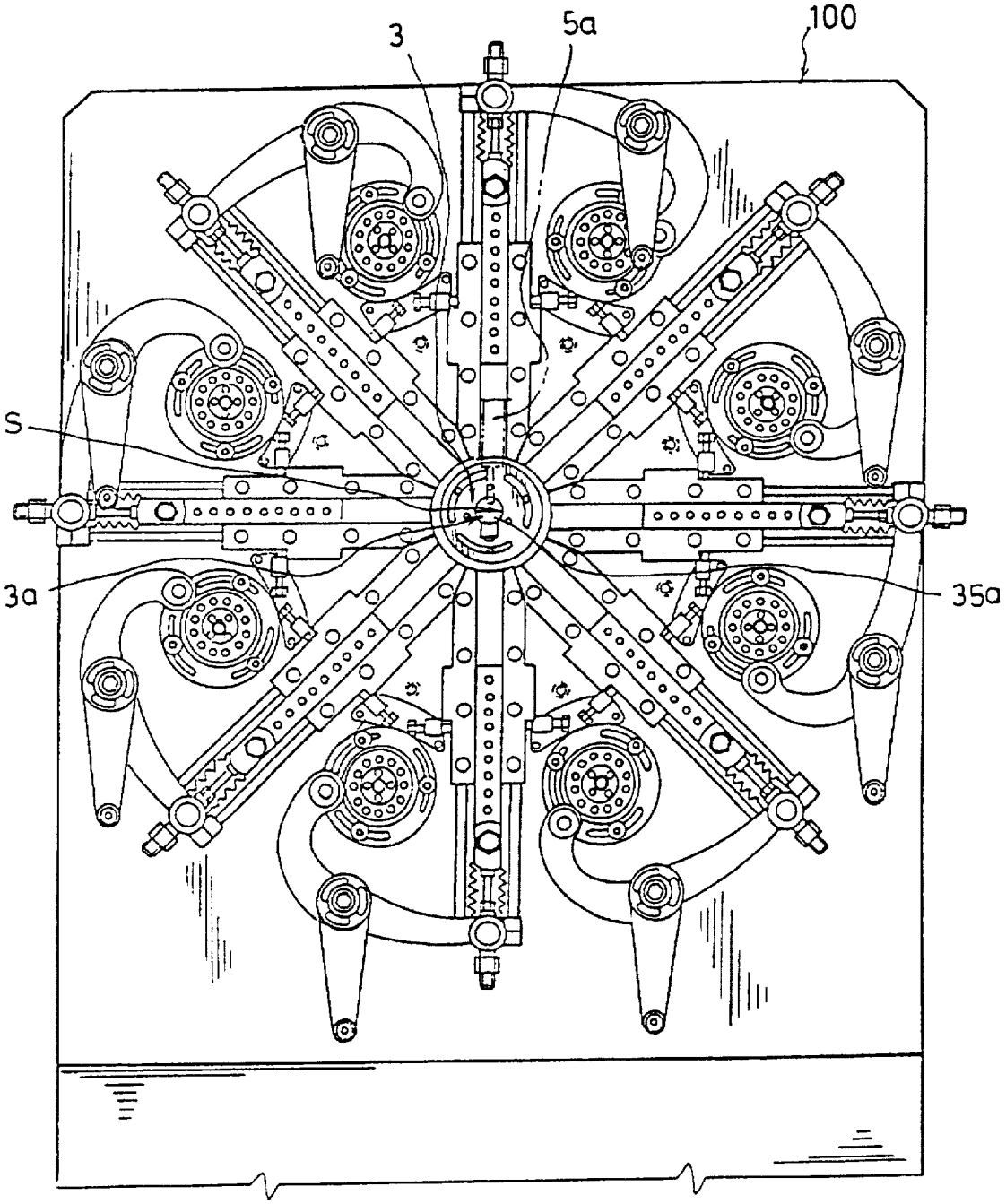
FIG. 7 is a similar view to FIG. 2, but with the core rotated through an angle of 180 degrees.
Figure 8A:
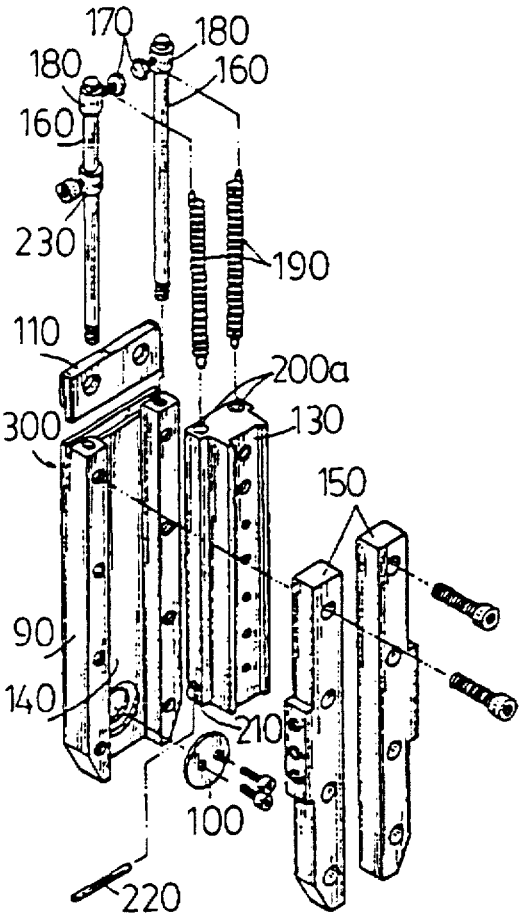
FIG. 8A shows an exploded view of the tool guiding means.
Figure 8B:
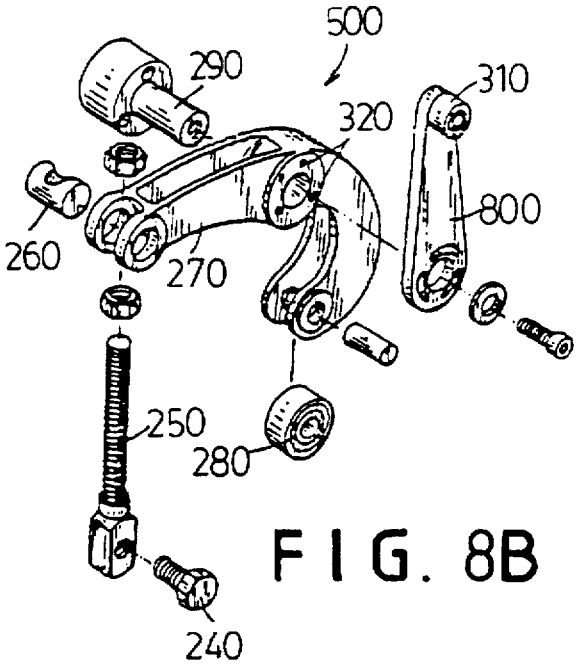
FIG. 8B illustrates a crank means for operating the forming tool of the present invention.
Figure 8C:
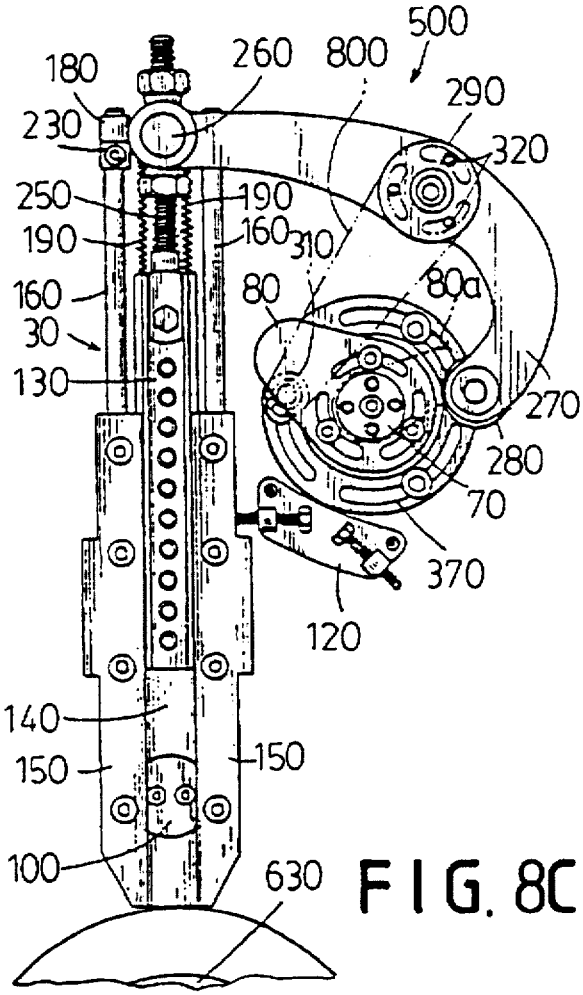
FIG. 8C illustrates the tool guiding means and the crank means of the present invention.
Figure 9:
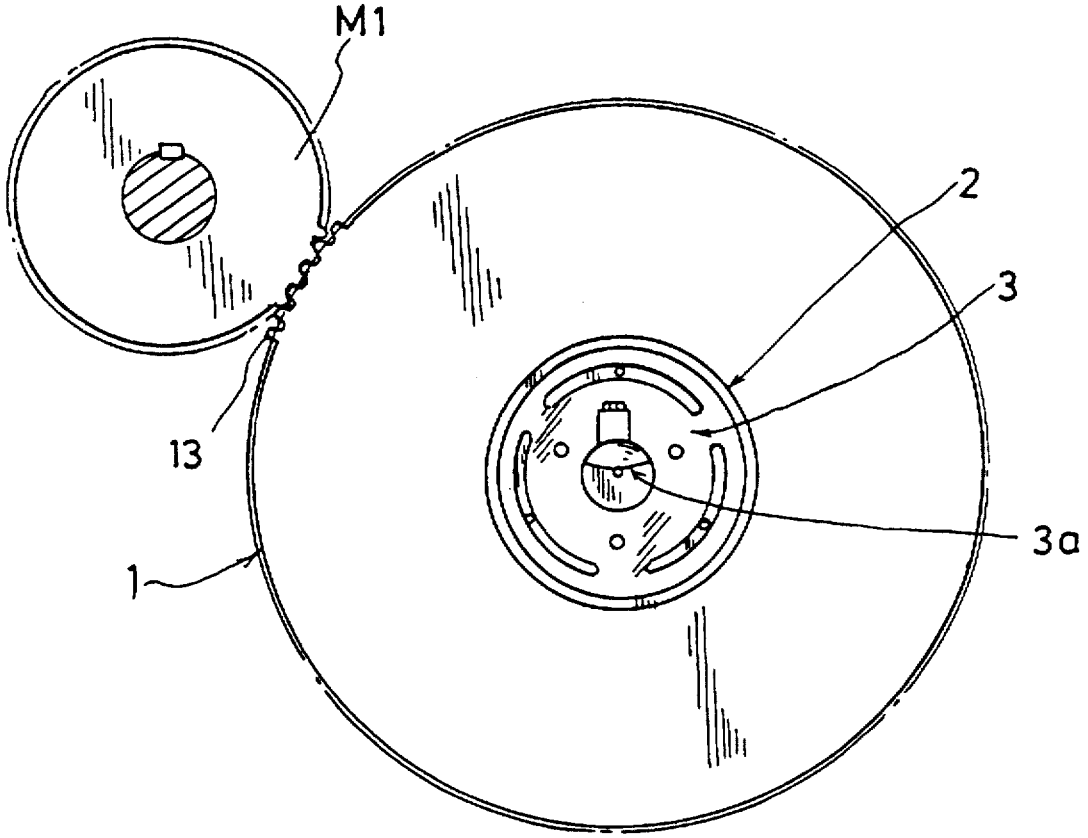
FIG. 9 illustrates the engagement between the driving disk and the motor.
Figure 10:
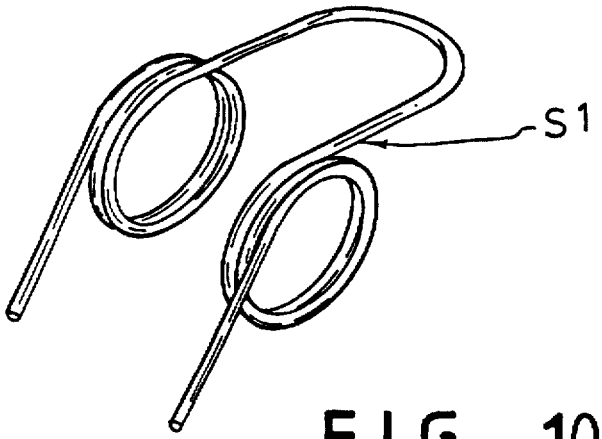
FIG. 10 is a perspective view of a spring of multiple orientations.
Figure 11:
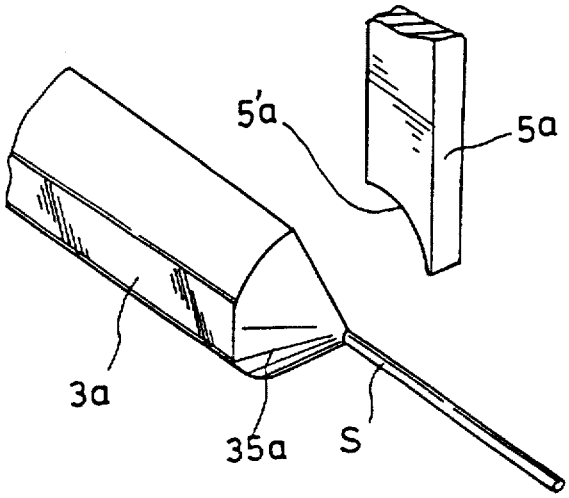
FIGS. 11–18 illustrates the procedures for forming the spring of multiple orientations shown in FIG. 10.
Figure 12:
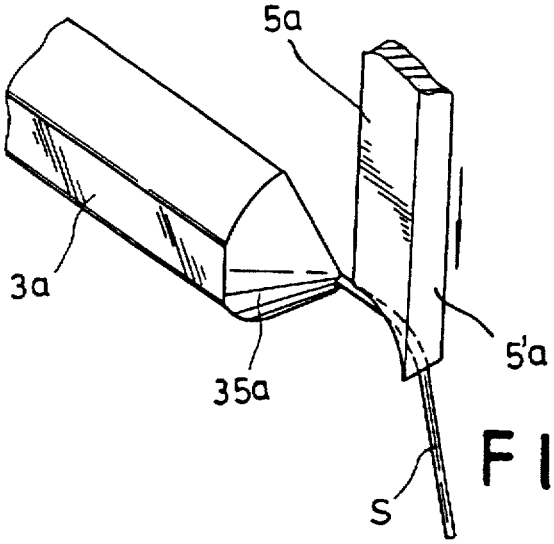
Figure 13:
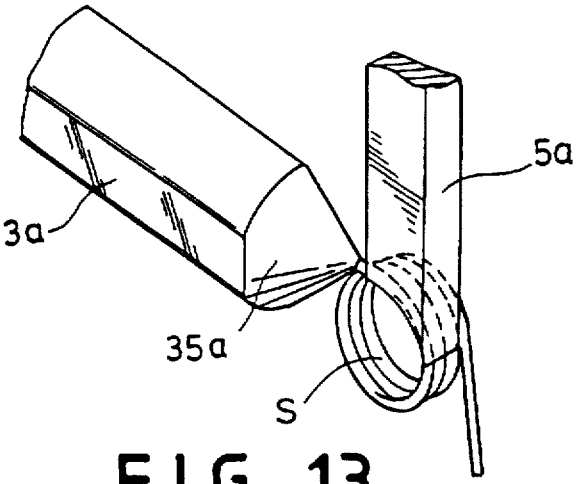
Figure 14:
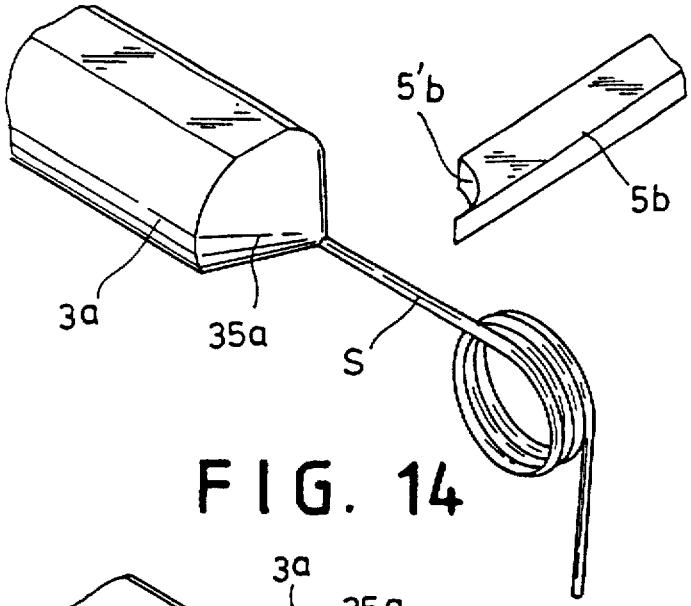
Figure 15:
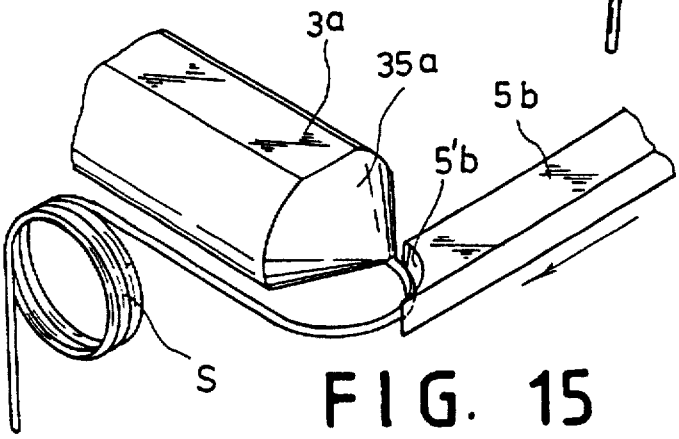
Figure 16:
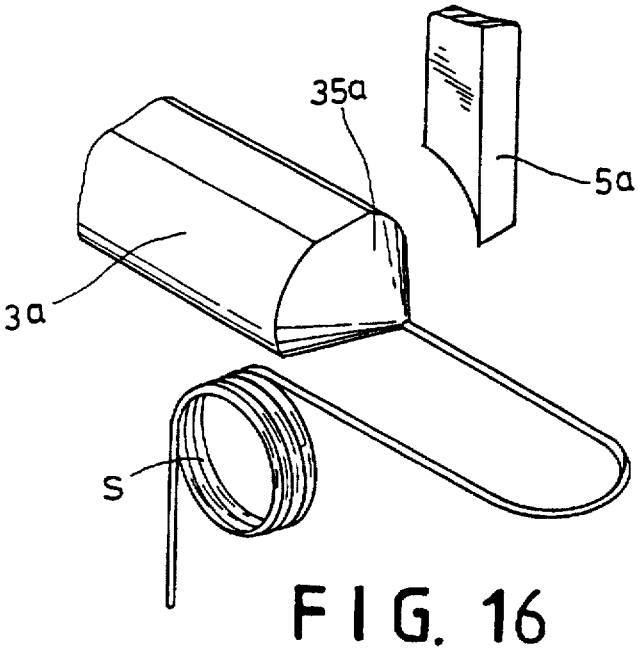
Figure 17:
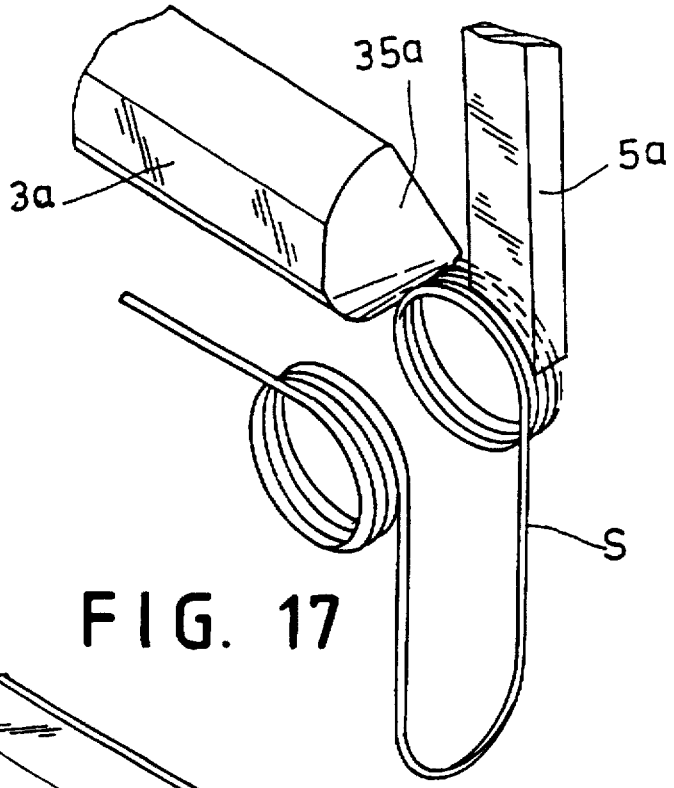
Figure 18:
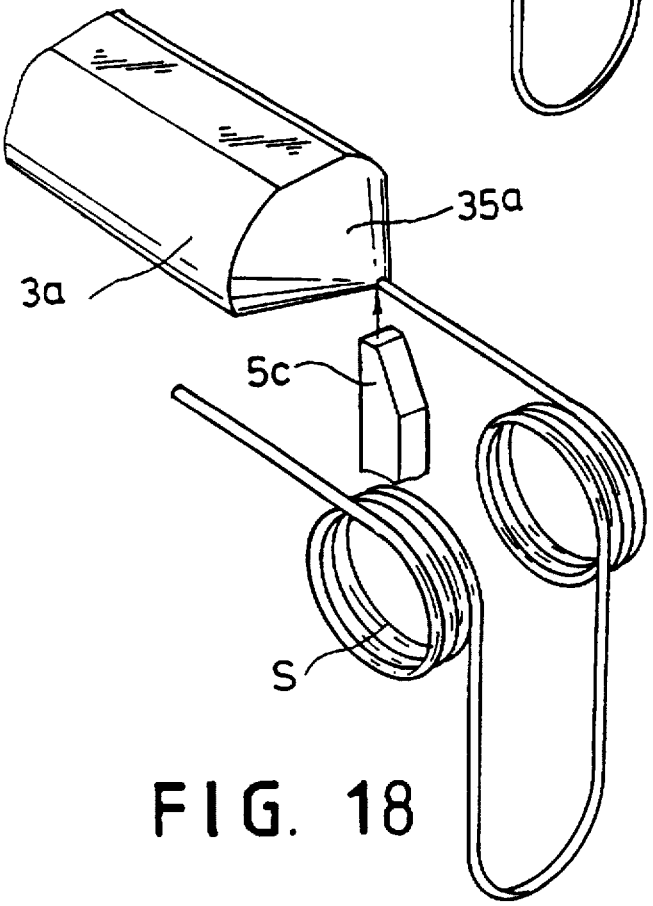

The present invention can be used to make a spring S1 as shown in FIG. 10. The position of the core 3*a* can be adjusted by the driving disk 1 through a microprocessor controller C. As shown in FIG. 7, the front end 35*a* of the core 3*a* is disposed at the upper position and so the forming tool 5*a* at the lower portion of the frame 100 can go upwardly to curve the spring wire S. When required to change the curving direction of the spring wire S, it is only necessary to rotate the core 3*a* to a position as shown in FIG. 7 (for example) thereby enabling the forming tool 5*b* at the upper portion of the frame 100 to go downwardly to curve the spring wire S. Hence, the spring S1 as illustrated in FIG. 10 can be easily made by the present invention according to the procedures as shown in FIGS. 11–18. As the core 3*a* is automatically controlled by the microprocessor controller, the core 3*a* will be rotated to avoid collision with the forming tool thus preventing the core 3*a* from being damaged.

Figure 19:
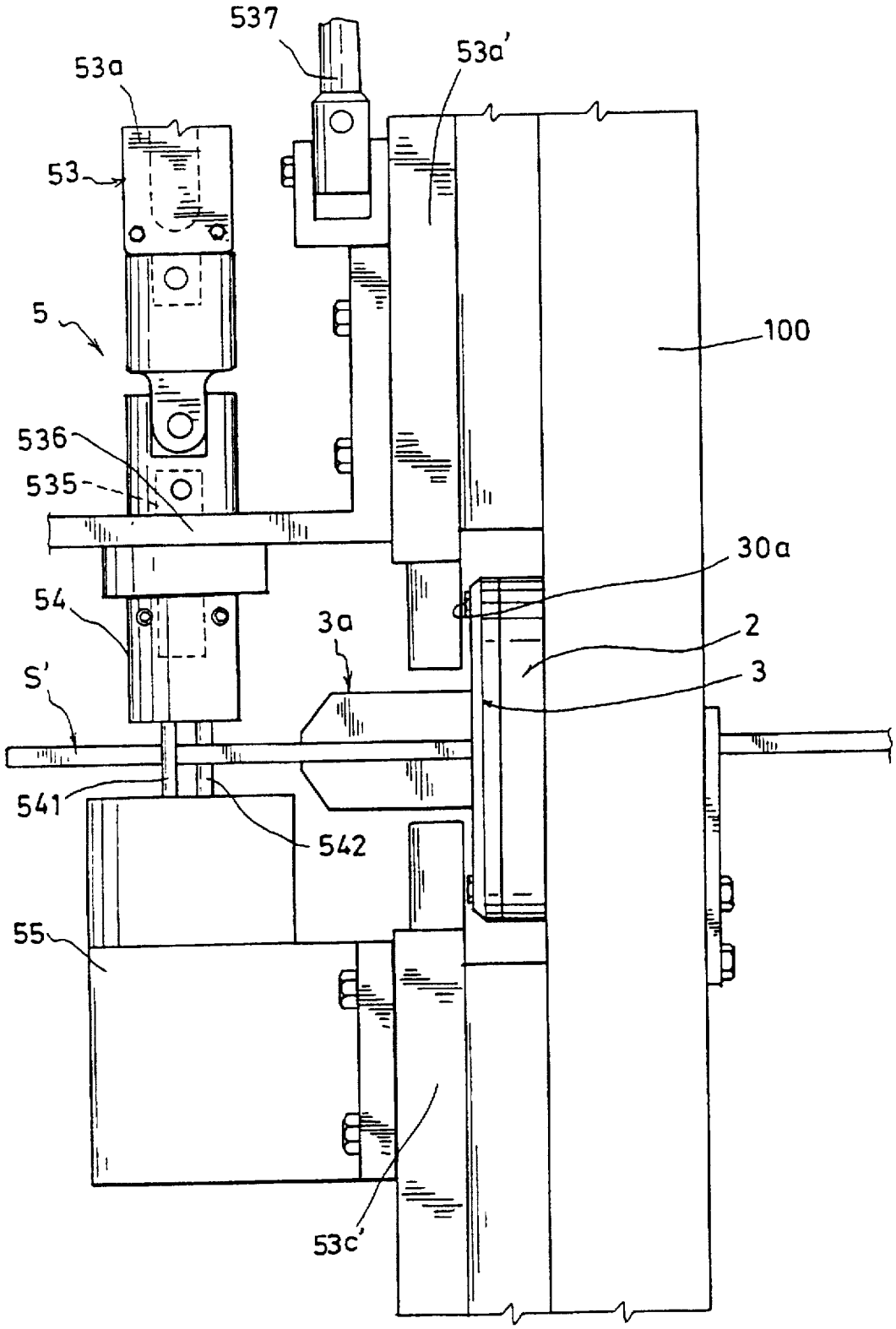
FIG. 19 illustrates how to install a bending device on the present invention.
Figure 20:
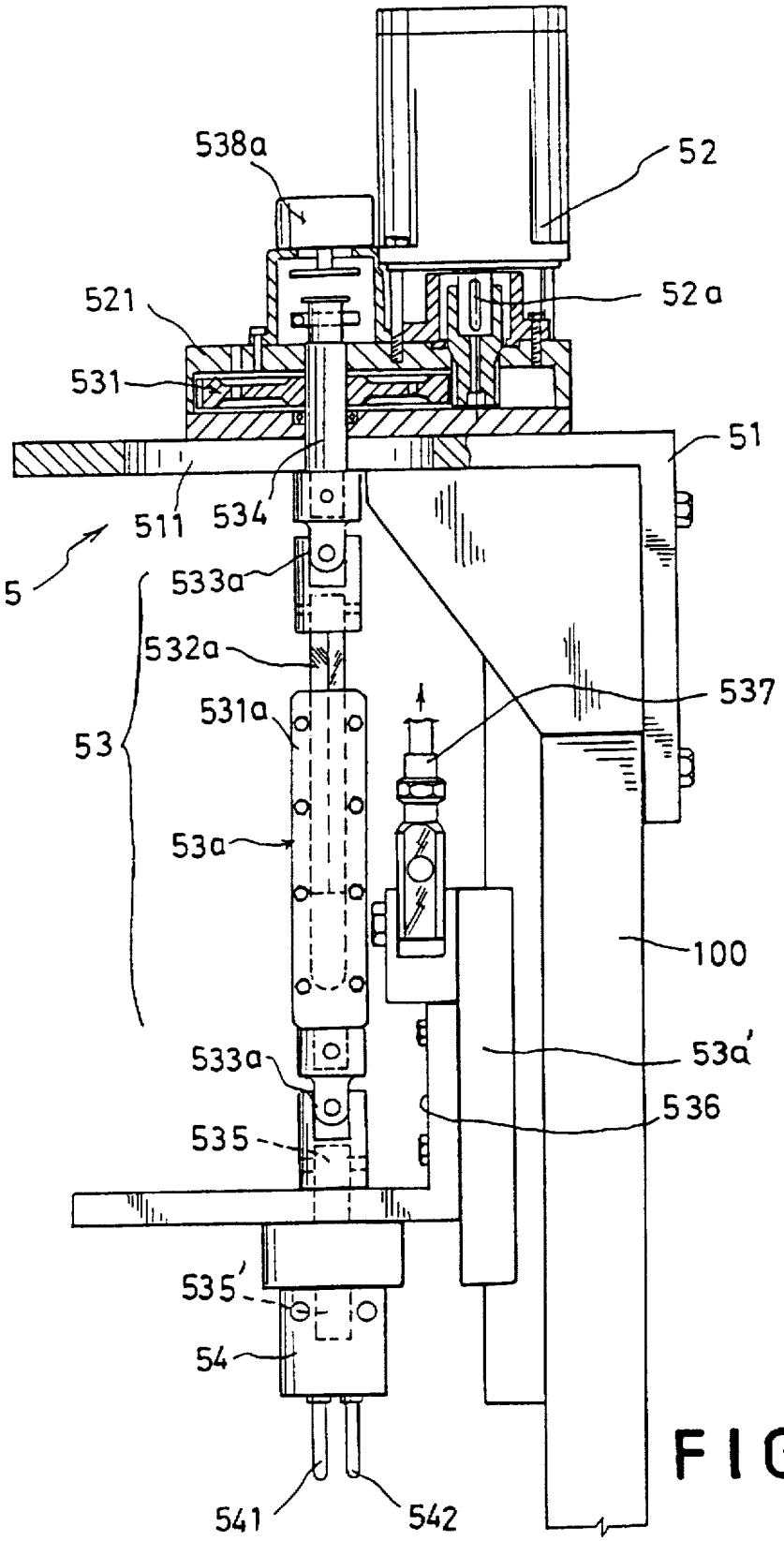
FIG. 20 illustrates the structure of the bending device.
Figure 21:
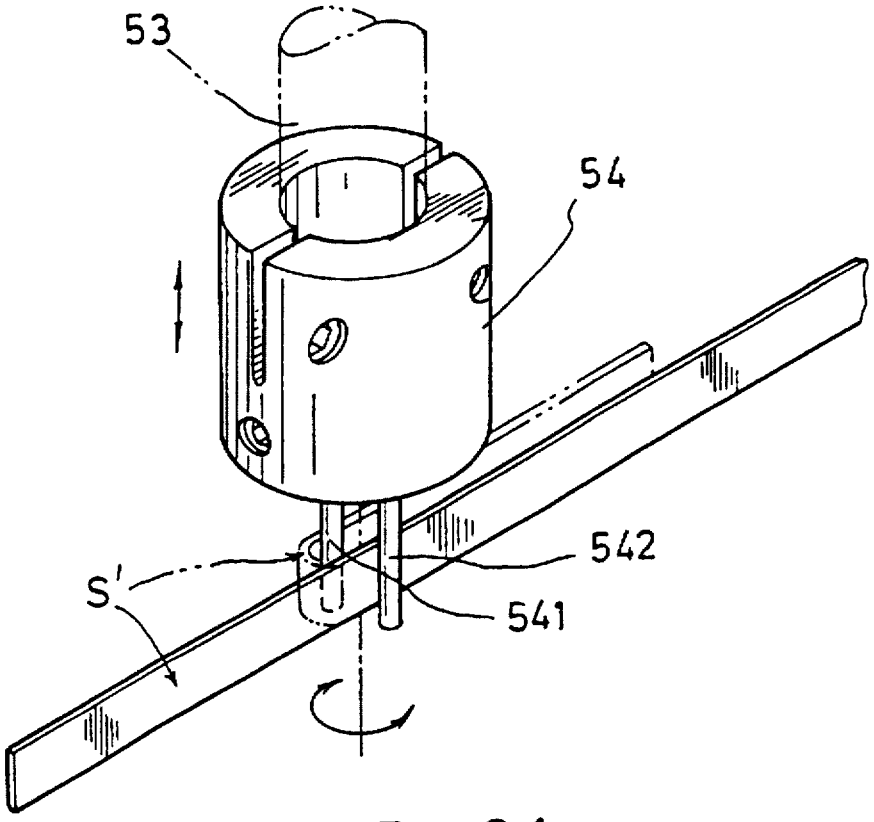
FIG. 21 illustrates how to make a spring with the bending device.
Figure 22:
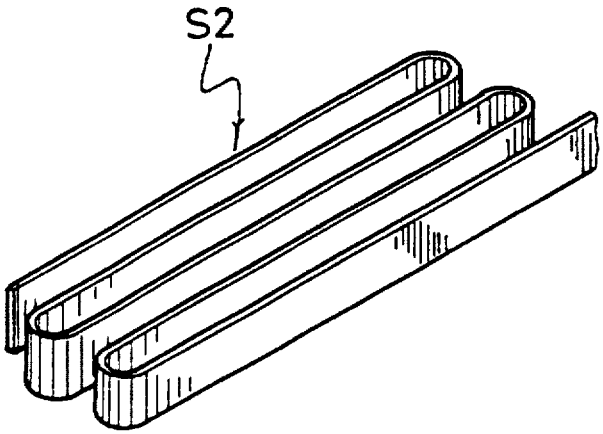
FIG. 22 is a perspective view of the spring made by the bending device.

Furthermore, the present invention can be associated with a bending device 5 to make a spring S2 as shown in FIG. 22. First of all, the bolts 30 are removed from the second sleeve 3 so that the second sleeve 3 is not connected with the driving disk 1 and the core 3*a* will no longer rotate in unison with the driving disk 1. Then, the second sleeve 3 is fixedly mounted on the first sleeve 2 by bolts 30*a* (see FIG. 19) extending through the curved slots 311 of the former into the threaded holes 23 of the latter. Thereafter, the bending machine 5 is installed on the frame 100. As shown in FIGS. 19, 20 and 21, the bending device 5 includes a bracket 51, a motor 52 and a transmission device 53. The bracket 51 is fixedly secured on the top of the frame 100. The motor 52 is fastened on a transmission box 521 which is in turn slidingly mounted on the bracket 51. The transmission device 53 is mounted under the bracket 51 and has a first shaft connected with the output shaft 52*a* of the motor 52 via a gearing 531. The transmission device 53 includes an elongated seat 531*a* in which is slidably fitted a sliding shaft 532*a*. The upper end of the sliding shaft 532*a* is provided with a universal joint 533*a* which is coupled to the first shaft 534. The lower end of the sliding shaft 532*a* is also provided with a universal joint 533*a* which is in turn coupled to a second shaft 535. The second shaft 535 is arranged on a bracket 536 which is in turn fixedly secured on the upper forming tool holder 53*a* of the spring wire feeding device. The forming tool holder 53*a* is connected with a resilient pulling means 537 which tends to pull the forming tool holder 53*a* to go upwards. The lower end 535' of the second shaft 535 is engaged with a bending head 54 provided with two downwardly depending pins 541 and 542. An anvil 55 is adjustably mounted on the lower forming tool holder 53*c* under the bending head 54. Hence, when the spring wire S' extends through the core 3*a* to the predetermined position, the transmission device 53 which is controlled by a microprocessor controller (not shown) will be lowered so that the spring wire S' will be fitted between the two pins 541 and 542 of the bending head 54. Then, the motor 52 will drive the transmission device 53 to rotate the bending head 54 to curve the spring wire S', as shown in FIG. 21. Thereafter, the bending head 54 is lifted by the upper forming tool holder 53*a* and the spring wire S' is further pushed out of the core 31*a* and then the bending head 54 is lowered to bend the spring wire S' again. As such, a spring S2 as shown in FIG. 22 will be obtained by repeating the above operations.

In conclusion, the present invention has the following advantages over the prior art:

1. The stroke number of the forming tool can be reduced.
2. The present invention can be used to produce springs of multiple orientations.
3. The core is sturdy in construction.
4. As the core is rotatable, the procedures for producing springs of multiple orientations will be simplified thereby increasing the production rate.

The structures and shapes of the present invention may be modified without departing from the spirit and scope of the invention. For example, a decoder 538*a* (see FIG. 10) may be mounted on the transmission device 53 of the bending machine 5 to control the motor 52.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A spring-making machine comprising:

a spring wire feeding device including:

a frame;

a driving disk rotatably mounted on said frame;

a first sleeve fixedly arranged on one side of said frame and having a plurality of fixing holes;

a second sleeve inserted into said first sleeve and fixedly mounted on said driving disk; and an elongated core having a sectorial portion with an angle less than 180 degrees at an end thereof and a opening at another end, said core having an axial hole and a radial outlet;

a guide rod having an axial hole adapted to receive a spring wire and having an end inserted into the axial hole of said core; and clamping means having a recess in which is fitted another end of said guide rod and a bolt extending through said clamping means to engage with said guide rod;

a plurality of sets of tool guiding means radially disposed on said frame for radially sliding a plurality of forming tools through a plurality of crank means; and a bending device including:

a bracket adapted to be fixedly secured on a top of a frame of a spring wire feeding device;

a transmission box slidably mounted on said bracket;

a motor fastened on said transmission box; and a transmission device mounted under said bracket and having a first shaft connected with an output shaft of said motor via a gearing, said transmission including an elongated seat in which is slidably fitted a sliding shaft provided at an upper end thereof with a universal joint which is in turn coupled to a first shaft, said sliding shaft being provided at a lower end thereof with a universal joint which is in turn coupled to a second shaft, said second shaft being arranged on a bracket which is adapted to be fixedly secured on an upper forming tool holder of said spring wire feeding device, said forming tool holder being connected with a resilient pulling means which tends to pull said forming tool holder to go upwards, said second shaft having a lower end engaged with a bending head provided with two downwardly depending pins, and an anvil adjustably mounted on a lower forming tool holder under said bending head.

* * * * *